US006550431B1

(12) United States Patent
Holmström

(10) Patent No.: US 6,550,431 B1
(45) Date of Patent: Apr. 22, 2003

(54) METHOD AND A DEVICE FOR DEGASSING A COOLING SYSTEM FOR AN INTERNAL COMBUSTION ENGINE

(75) Inventor: Jan Christian Holmström, Västra Frölunda (SE)

(73) Assignee: Volvo Lastvagnar AB (SE)

( * ) Notice: Subject to any disclaimer, the term of this patent is extended or adjusted under 35 U.S.C. 154(b) by 0 days.

(21) Appl. No.: 09/762,001

(22) PCT Filed: Jul. 26, 1999

(86) PCT No.: PCT/SE99/01312

§ 371 (c)(1),
(2), (4) Date: Apr. 5, 2001

(87) PCT Pub. No.: WO00/06873

PCT Pub. Date: Feb. 10, 2000

(30) Foreign Application Priority Data

Jul. 31, 1998 (SE) ..... 9802655

(51) Int. Cl.[7] ..... F01P 3/22
(52) U.S. Cl. ..... 123/41.54; 165/917
(58) Field of Search ..... 123/41.01–41.12, 123/41.18, 41.2–41.32, 41.42, 41.47, 41.5, 41.51, 41.54; 165/11, 51, 104, 119, 917, 111, 110, 150, 149; 210/235, 167; 236/34, 34.5, 92 R; 220/203; 237/13, 9 R

(56) References Cited

U.S. PATENT DOCUMENTS 3,726,262 A * 4/1973 Moon ..... 123/41.1
5,309,870 A * 5/1994 Ap ..... 123/41.21

FOREIGN PATENT DOCUMENTS

EP 0302245 A1 * 2/1989 ..... F01P/3/20
WO 98/15725 * 4/1998 ..... F01P/7/16

OTHER PUBLICATIONS

Derwent's abstract, No. 86–142771/22, week 8622, Abstract of SU, 1188346 (Moscow Likhachev Car WKS), Nov. 30, 1985.*

* cited by examiner

*Primary Examiner*—Noah P. Kamen
(74) *Attorney, Agent, or Firm*—Lerner, David, Littenberg, Krumholz & Mentlik, LLP

(57) ABSTRACT

The present invention relates to a method for degassing a cooling system for an internal combustion engine (1), in which a coolant is brought to circulate on the one hand in a cooling circuit between the engine and a radiator unit (2) and on the other between the engine and a bypass circuit, past the radiator unit. The coolant is hereby controlled, in dependence of the temperature, to flow through the cooling circuit and/or the bypass circuit, and the degassing is performed through draining off a limited coolant flow. The degassing is achieved by draining off of a limited portion of that coolant flow which is brought to flow through the bypass circuit, and is thus performed in dependence of the coolant temperature.

6 Claims, 1 Drawing Sheet

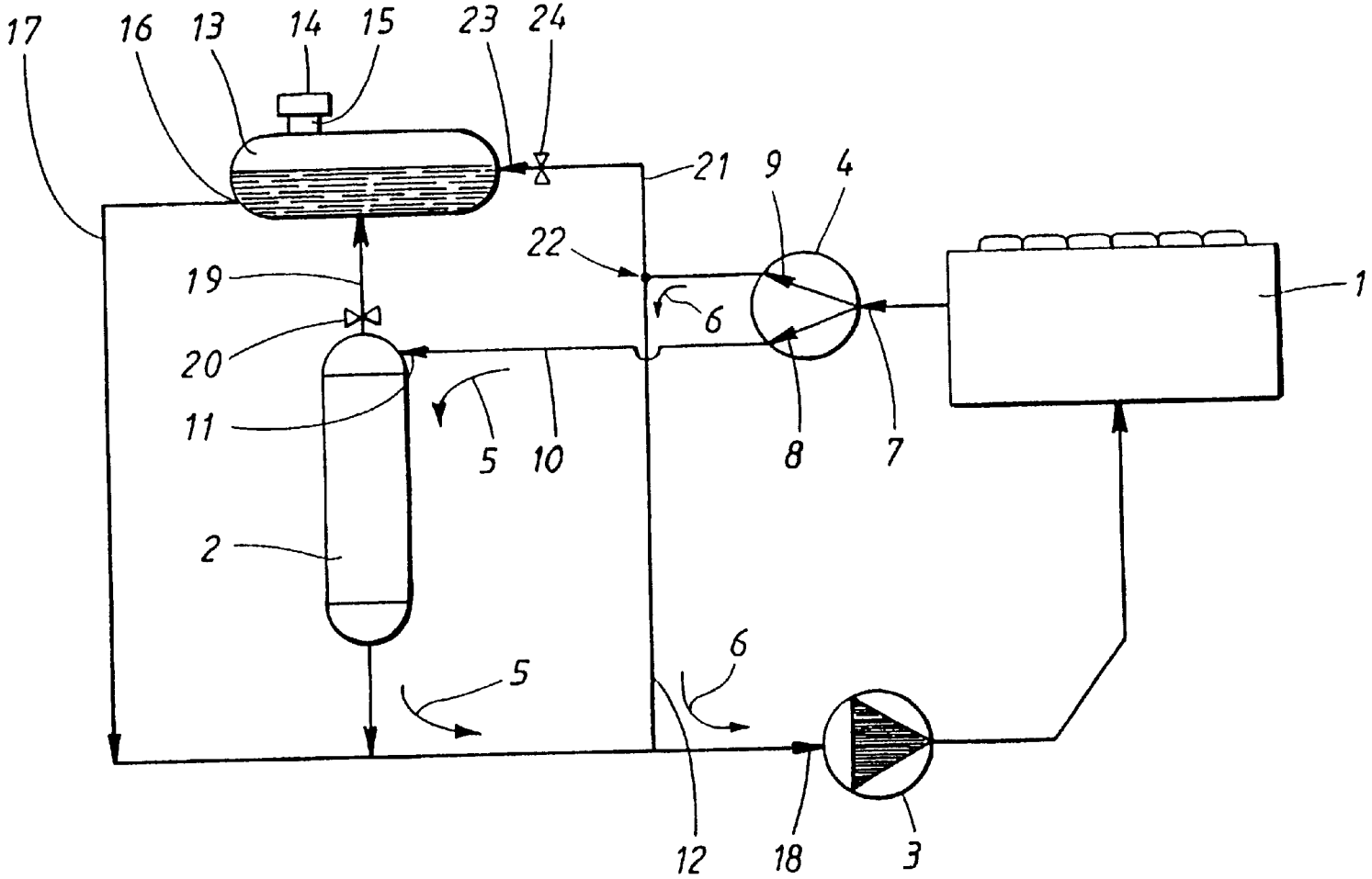
1
7
4
9
8
21
6
22
24
23
15
14
13
16
17
10
5
19
20
11
2
6
12
3
18

METHOD AND A DEVICE FOR DEGASSING A COOLING SYSTEM FOR AN INTERNAL COMBUSTION ENGINE

TECHNICAL FIELD

The present invention relates to a method and a device for degassing a cooling system for an internal combustion engine, in which a coolant is brought to circulate partly in a cooling circuit between the engine and a radiator unit and partly between the engine and a bypass circuit past the radiator unit, the coolant flow being controlled, in dependence of the temperature, to flow through the cooling circuit and/or the bypass circuit, and the degassing being performed through draining off a limited coolant flow.

BACKGROUND ART

In principle, cooling systems for internal combustion engines are closed systems, in which the coolant is circulated, under a certain pressure, by the coolant pump. When filling up, and also during operation, gas pockets may occur inside the system, which is degassed continuously by means of degassing passages, which also release a small amount of coolant to an expansion reservoir. Hereby, a so-called parasite flow will occur, i.e. a non-wanted flow of coolant, which is however re-circulated, and will be pressurised again in the coolant pump. Nevertheless, due to this, the pump must be sized for a larger flow than the useful coolant flow, thus limiting the efficient capacity of the pump.

DISCLOSURE OF INVENTION

The object of the present invention is to provide a method and a device, whereby the non-useful coolant flow can be reduced.

Said object is achieved by a method and a device according to the invention, whereby degassing is obtained through draining off of a limited portion of that coolant flow which is brought to flow through the bypass circuit. Hereby it is achieved, that when the cooling requirement is at a maximum, the entire coolant flow will be directed through the radiator unit.

DESCRIPTION OF THE DRAWING

The invention will be explained in more detail by way of an embodiment example, with reference to the accompanying drawing, in which the FIGURE schematically illustrates a cooling system according to the invention.

PREFERRED EMBODIMENT

The FIGURE shows, schematically, an internal combustion engine 1, of e.g. the diesel type, for propulsion of automotive vehicles, ships or other machinery, such as power plants, forest machinery, etc. The FIGURE further schematically depicts a cooling system for cooling the combustion engine 1 by bringing a coolant flow to circulate through cooling ducts in the engine cylinder block and cylinder head, and between the engine and a radiator unit 2 comprised in the cooling system, intended for through flow of the coolant, which is subjected to cooling air. The cooling system further comprises a pump 3, being driven either by the combustion engine 1 or by a separate electric motor. The system includes a thermostatic valve 4, functioning to control the coolant flow, in dependence of the coolant temperature, between a cooling circuit, see arrow 5, through the radiator unit 2, or a shunt or bypass circuit, see arrow 6, conducting the coolant past the radiator unit 2. The thermostatic valve 4 exhibits an inlet passage, 7, and two outlet passages 8, 9. The inlet passage 7 is connected to the cooling ducts in the combustion engine 1, whereas one outlet passage, 8, is connected through a cooling line 10 to an inlet 11 of the radiator unit 2, and thus leads to the cooling circuit, whereas the other outlet passage 9 is connected to a bypass or shunt line 12, thus defining the bypass or shunt circuit discussed above. The thermostatic valve 4 is functioning, at temperatures below a selected lower limit value, to direct the coolant flow through the outlet passage 9 to the bypass line 12 and, for a rising temperature, when the selected lower limit value has been exceeded, to successively close the outlet passage 9 and open the outlet passage 8, so as, when exceeding an upper limit value, to direct the flow to the cooling circuit, i. e. via the cooling line 10 and the radiator 2. For a dropping temperature, when the coolant has reached the upper limit value, the coolant flow is again successively directed from the cooling circuit via the outlet passage 8, to the bypass circuit 6 via the outlet passage 9, until, when the lower limit value has been passed, it is directed entirely through the outlet passage 9. Depending on the type of thermostat, the temperature regulation may be of the on/off type, with rapid changes between the two end positions of the valve, or of the slow, gradual type with the valve being partly open towards both outlet passages 8, 9.

The cooling system further comprises a coolant reservoir 13, partly functioning as a replenishing reservoir for the coolant, partly as an expansion reservoir, which will be explained further below. The coolant reservoir 13 exhibits a removable pressure cap 14, closing off a coolant replenishing opening 15. The coolant reservoir 13 is provided with a bottom coolant outlet 16 for a replenishing line 17, connected to the inlet side 18 of the pump 3.

From the radiator unit 2, more particularly from its top end, a degassing line 19 is connected to the coolant reservoir 13 for the release of entrapped air from the radiator unit 2. In this process, a certain amount of coolant waste flow is also released, in the order of about 1% of the pump flow. This flow is limited by means of a flow limiter 20, in the form of a preferably fixed restriction inserted into the degassing line 19.

For degassing of the remaining parts of the cooling system, such as the cooling ducts inside the combustion engine 1, and the pump 3, a further degassing line 21 is arranged, with one end, 22, thereof connected to the thermostatic valve 4 outlet 9 to the bypass circuit, i.e. the bypass line 12, and the other end, 23, running into the coolant reservoir 13. The mouth is advantageously located at the top end of the reservoir, but, in principle, it might also be located below the coolant level in the reservoir. The degassing line 21 from the outlet 9 of the thermostatic valve exhibits a flow limiter 24 in the form of a preferably fixed restriction, securing a limitation of the coolant flow to about 2% of the total flow.

Through the arrangement described above, with degassing after the thermostatic valve, 4, i.e. at the outlet side thereof and, more particularly, on that side which is connected to the bypass circuit, i.e. the line 12, a limited portion of that coolant flow which is brought to flow through the bypass circuit 6 is drained off. Thereby, the degassing and the waste flow will vary in such a way, depending on temperature, that when the cooling requirement is at a maximum, the entire coolant flow is brought to flow through the radiator unit. In an actual case, with a thermostat having a lower temperature limit value of e.g. 86° C. and an upper limit value of 96° C., the degassing is controlled by the thermostatic valve as follows:

For coolant temperatures below 86° C., degassing takes place only through the degassing line 21.

For coolant temperatures in the range of 86–96° C., degassing takes place through both degassing lines, 19 and 21.

For coolant temperatures exceeding 96° C., degassing takes place only through the degassing line 19, i.e. the degassing of the flow through the thermostatic valve 4 is then interrupted.

To summarise, the present invention can thus be regarded on the one hand as a method and on the other as a device for degassing a cooling system of an internal combustion engine. The method, in summary, consists of bringing coolant, for cooling of the engine, to circulate between the engine and the cooling circuit through the radiator unit 2 and/or through a bypass circuit, past the radiator unit, depending on the temperature, whereby the coolant flow is directed between the two circuits by means of the thermostat-controlled valve 4 and whereby degassing of the cooling system is performed in dependence of the coolant temperature.

The invention is not limited to the embodiment example described above and shown in the drawing, but can be varied within the scope of the appended patent claims. By way of example, it is conceivable, in principle, to eliminate the degassing through the line 19 from the radiator unit 2.

What is claimed is:

1. Apparatus for degassing a cooling system for an internal combustion engine comprising a radiator for cooling a flow of coolant through said cooling system, a first conduit connecting said internal combustion engine to said radiator, a second conduit connected to said internal combustion engine for bypassing said radiator, a pump including an inlet side and an outlet side for circulating said coolant through said first and second conduits, a thermostatic valve having a first outlet and a second outlet for selectively controlling said flow of said coolant through said first and second conduits based upon the temperature of said coolant, said first conduit connected to said first outlet of said thermostatic valve and said second conduit connected to said second outlet of said thermostatic valve, a coolant reservoir, and a third conduit comprising at least one degassing line connected to said coolant reservoir and at least one replenishing line connecting said coolant reservoir to said inlet side of said pump, said degassing line connected to said second conduit wherein said thermostatic valve closes off said degassing line when said coolant temperature reaches or exceeds a predetermined maximum temperature value.

2. The apparatus of claim 1 wherein said at least one degassing line is a first degassing line, wherein said apparatus includes a second degassing line connecting said radiator to said coolant reservoir for permitting a limited flow therebetween, and wherein said thermostatic valve terminates said limited flow when said coolant temperature reaches or is below a predetermined temperature value.

3. The apparatus of claim 2 wherein said second degassing line further includes a flow limiter.

4. The apparatus of claim 3 wherein said flow limiter is a fixed restriction.

5. A method for degassing a cooling system for an internal combustion engine including circulating at least a portion of a coolant for said cooling system through a first conduit connecting said internal combustion engine and a radiator, circulating at least another portion of said coolant through a second conduit connected to said internal combustion engine and bypassing said radiator, selectively controlling said flow of said coolant through said first and second conduits based on the temperature of said coolant, and degassing said cooling system by draining off a limited flow of said coolant through said second conduit.

6. The method of claim 5 including interrupting said degassing of said cooling system when said coolant temperature reaches or exceeds a predetermined maximum temperature.

* * * * *

UNITED STATES PATENT AND TRADEMARK OFFICE

CERTIFICATE OF CORRECTION

PATENT NO. : 6,550,431 B1
DATED : April 22, 2003
INVENTOR(S) : Jan Christian Holmstrom It is certified that error appears in the above-identified patent and that said Letters Patent is hereby corrected as shown below:

Delete the specification and substitute the attached specification.

Signed and Sealed this

Fifteenth Day of February, 2005

JON W. DUDAS
*Director of the United States Patent and Trademark Office*

A METHOD AND A DEVICE FOR DEGASSING A COOLING SYSTEM FOR AN INTERNAL COMBUSTION ENGINE

FIELD OF THE INVENTION

[0001] The present invention relates to a method and apparatus for degassing a cooling system for an internal combustion engine, in which a coolant circulates partly in a cooling circuit between the engine and a radiator unit and partly between the engine and a bypass circuit past the radiator unit, the coolant flow being controlled, dependent upon the temperature, to flow through the cooling circuit and/or the bypass circuit, and the degassing being performed by draining off a limited coolant flow.

BACKGROUND OF THE INVENTION

[0002] In principle, cooling systems for internal combustion engines are closed systems, in which the coolant is circulated, under pressure, by the coolant pump. During filling, as well as during actual operation, gas pockets may occur inside the system, which is continuously degassed by means of degassing passages, which also release a small amount of coolant to an expansion reservoir. In this manner, a so-called parasite flow will occur, i.e. a flow of coolant which is not desired, but which is nevertheless re-circulated, and will again be pressurised in the coolant pump. Nevertheless, due to this, the pump must be sized for a larger flow than the useful coolant flow, thus limiting the efficient capacity of the pump.

[0003] One object of the present invention is to provide a method and apparatus, whereby this non-useful coolant flow can be reduced.

SUMMARY OF THE INVENTION

[0004] In accordance with the present invention, this and other objects have now been realized by the discovery of a method for degassing a cooling system for an internal combustion engine including circulating at least a portion of a coolant for the cooling system through a first conduit connecting the internal combustion engine and a radiator, circulating at least another portion of the coolant through a second conduit connected to the internal combustion engine and bypassing the radiator, selectively controlling the flow of the coolant through the first and second conduits based on the temperature of the coolant, and degassing the cooling system by draining off a limited flow of the coolant through the second conduit. In a preferred embodiment, the method includes interrupting the degassing of the cooling system when the coolant temperature reaches or exceeds a predetermined maximum temperature.

[0005] In accordance with the present invention, this and other objects have also been realized by the discovery of apparatus for degassing a cooling system for an internal combustion engine comprising a radiator for cooling a flow of coolant through the cooling system, a first conduit connecting the internal combustion engine to the radiator, a second conduit connected to the internal combustion engine for bypassing the radiator, a pump including an inlet side and an outlet side for circulating the coolant through the first and second conduits, a thermostatic valve for selectively controlling the flow of the coolant through the first and second conduits based upon the temperature of the coolant, a coolant reservoir, and a third conduit comprising at least one degassing line connected to the coolant reservoir and at least one replenishing line connecting the coolant reservoir to the inlet side of the pump, the degassing line connected to the second conduit. In a preferred embodiment, the thermostatic valve closes off the degassing line when the coolant temperature reaches or exceeds a predetermined maximum temperature value. In accordance with another embodiment, the apparatus includes a secondary degassing line connecting the radiator to the coolant reservoir for permitting a limited flow therebetween, and including shut-off means for terminating the limited flow when the coolant temperature reaches or is below a predetermined temperature value.

[0006] In accordance with the present invention, these objects are achieved by a method and apparatus in which degassing is obtained through draining off of a limited portion of the coolant flow which is caused to flow through the bypass circuit. In this manner, when the cooling requirement is at a maximum, the entire coolant flow will be directed through the radiator unit.

BRIEF DESCRIPTION OF THE DRAWING

[0007] The present invention will be explained in more detail in the following detailed description, with reference to the accompanying drawing, in which:

[0008] The figure is a top, elevational, schematic illustration of a cooling system according to the present invention.

[0009] DETAILED DESCRIPTIONThe figure shows, schematically, an internal combustion engine 1, of e.g. the diesel type, for propulsion of automotive vehicles, ships or other machinery, such as power plants, forest machinery, etc. The figure further schematically depicts a cooling system for cooling the combustion engine 1 by causing a coolant flow to circulate through cooling ducts in the engine cylinder block and cylinder head, and between the engine and a radiator unit 2 located in the cooling system, intended for through flow of the coolant, which is thus subjected to cooling air. The cooling system further comprises a pump 3, driven either by the combustion engine 1 or by a separate electric motor. The system includes a thermostatic valve 4, functioning to control the coolant flow, dependent upon the coolant temperature, between a cooling circuit (see arrow 5) through the radiator unit 2, or a shunt or bypass circuit (see arrow 6) conducting the coolant past the radiator unit 2. The thermostatic valve 4 exhibits an inlet passage, 7, and two outlet passages, 8 and 9. The inlet passage 7 is connected to the cooling ducts in the combustion engine 1, whereas one outlet passage, 8, is connected through a cooling line 10 to an inlet 11 of the radiator unit 2, and thus leads to the cooling circuit, whereas the other outlet passage 9 is connected to a bypass or shunt line 12, thus defining the bypass or shunt circuit discussed above. The thermostatic valve 4 functions at temperatures below a selected lower limit value, to direct the coolant flow through the outlet passage 9 to the bypass line 12 and, for a rising temperature, when the selected lower limit value has been exceeded, to successively close the outlet passage 9 and open the outlet passage 8, so as, when exceeding an upper limit value, to direct the flow to the cooling circuit, i. e. through the cooling line 10 and the radiator 2. For a dropping temperature, when the coolant has reached the upper limit value, the coolant flow is again successively directed from the cooling circuit through the outlet passage 8, to the bypass circuit 6 by means of the outlet passage 9, until, when the lower limit value has been passed, it is directed entirely through the outlet passage 9. Depending on the type of thermostat, the temperature regulation may be of the on/off type, with rapid changes between the two end positions of the valve, or of the slow, gradual type with the valve being partly open towards both outlet passages, 8 and 9.

[0010] The cooling system further comprises a coolant reservoir 13, partly functioning as a replenishing reservoir for the coolant, partly as an expansion reservoir, which will be explained further below. The coolant reservoir 13 exhibits a removable pressure cap 14, closing off a coolant replenishing opening 15. The coolant reservoir 13 is provided with a bottom coolant outlet 16 for a replenishing line 17, connected to the inlet side 18 of the pump 3.

[0011] From the radiator unit 2, more particularly from its top end, a degassing line 19 is connected to the coolant reservoir 13 for the release of entrapped air from the radiator unit 2. In this process, a certain amount of coolant waste flow is also released, in the order of about 1% of the pump flow. This flow is limited by means of a flow limiter 20, preferably in the form of a fixed restriction inserted into the degassing line 19.

[0012] For degassing the remaining parts of the cooling system, such as the cooling ducts inside the combustion engine 1, and the pump 3, a further degassing line 21 is arranged, with one end, 22, connected to the thermostatic valve 4 outlet 9 to the bypass circuit, i.e. the bypass line 12, and the other end, 23, running into the coolant reservoir 13. The mouth is advantageously located at the top end of the reservoir, but, in principle, it might also be located below the coolant level in the reservoir. The degassing line 21 from the outlet 9 of the thermostatic valve exhibits a flow limiter 24, preferably in the form of a fixed restriction, securing a limitation of the coolant flow to about 2% of the total flow.

[0013] By means of the arrangement described above, with degassing after the thermostatic valve, 4, i.e. at the outlet side thereof and, more particularly, on that side which is connected to the bypass circuit, i.e. the line 12, a limited portion of that coolant flow which is caused to flow through the bypass circuit 6 is drained off. In this manner, the degassing and the waste flow will vary in such a way, depending on temperature, that when the cooling requirement is at a maximum, the entire coolant flow is brought to flow through the radiator unit. In an actual case, with a thermostat having a lower temperature limit value of e.g. 86°C and an upper limit value of 96°C, degassing is controlled by the thermostatic valve as follows:

[0014] For coolant temperatures below 86°C, degassing takes place only through the degassing line 21.

[0015] For coolant temperatures in the range of 86-96°C, degassing takes place through both degassing lines, 19 and 21.

[0016] For coolant temperatures exceeding 96°C, degassing takes place only through the degassing line 19, i.e. the degassing of the flow through the thermostatic valve 4 is then interrupted.

[0017] To summarise, the present invention can thus be regarded on the one hand as a method and on the other as apparatus for degassing a cooling system of an internal combustion engine. The method, in summary, consists of bringing coolant, for cooling of the engine, to circulate between the engine and the cooling circuit through the radiator unit 2 and/or through a bypass circuit, past the radiator unit, depending on the temperature, whereby the coolant flow is directed between the two circuits by means of the thermostat-controlled valve 4 and whereby degassing of the cooling system is performed in dependence of the coolant temperature.

[0018] The present invention is not limited to the embodiment described above and shown in the drawing, but can be varied within the scope of the appended patent claims. By way of example, it is conceivable, in principle, to eliminate the degassing through the line 19 from the radiator unit 2.